United States Patent [19]

Ducay et al.

[11] Patent Number: 4,903,855

[45] Date of Patent: Feb. 27, 1990

[54] CLOSURE AND PORT ASSEMBLY

[75] Inventors: James Ducay, Grayslake; Josef Schmidt, Libertyville, both of Ill.; Hugh Forman, Waukesha, Wis.

[73] Assignee: Baxter International Inc., Deerfield, Ill.

[21] Appl. No.: 276,273

[22] Filed: Nov. 25, 1988

[51] Int. Cl.[4] ..... B65D 41/32

[52] U.S. Cl. ..... 220/356; 220/266; 215/249; 215/253

[58] Field of Search ..... 220/356, 266; 215/247, 215/249, 253, DIG. 3; 604/400, 415

[56] References Cited

U.S. PATENT DOCUMENTS

| | | | |
|---|---|---|---|
| 3,379,326 | 4/1968 | Andersen . | |
| 3,509,879 | 5/1970 | Bathish et al. | 220/266 X |
| 3,904,060 | 9/1975 | McPhee . | |
| 3,920,141 | 11/1975 | Bojardi . | |
| 3,994,412 | 11/1976 | Difiglio | 215/249 X |
| 4,180,173 | 12/1979 | Diaz . | |
| 4,303,067 | 12/1981 | Connolly et al. | 215/247 X |
| 4,393,909 | 7/1983 | Pearson . | |
| 4,402,420 | 9/1983 | Chernack | 215/253 X |
| 4,430,077 | 2/1984 | Mittleman et al. | 215/249 |
| 4,616,760 | 10/1986 | Kersten et al. . | |
| 4,632,267 | 12/1986 | Fowles et al. | 215/253 |
| 4,779,997 | 10/1988 | Schmidt . | |

FOREIGN PATENT DOCUMENTS

| | | |
|---|---|---|
| WO86/02906 | 3/1971 | PCT Int'l Appl. . |
| WO86/02907 | 11/1978 | PCT Int'l Appl. . |
| 1223397 | 12/1971 | United Kingdom . |

*Primary Examiner*—Steven M. Pollard

*Attorney, Agent, or Firm*—Paul E. Schaafsma; Mary J. Schnurr; Paul C. Flattery

[57] ABSTRACT

A port and closure assembly is provided. The port and closure assembly comprises a port including a tubular portion that extends from a base, the tubular portion terminating at an end including an opening. A closure is provided for sealing at least a portion of the end of the port, the port and closure being constructed from materials that create a tack seal when the closure is positioned on the port and the port and closure are sterilized, the tack seal functioning to secure the closure to the port.

21 Claims, 2 Drawing Sheets

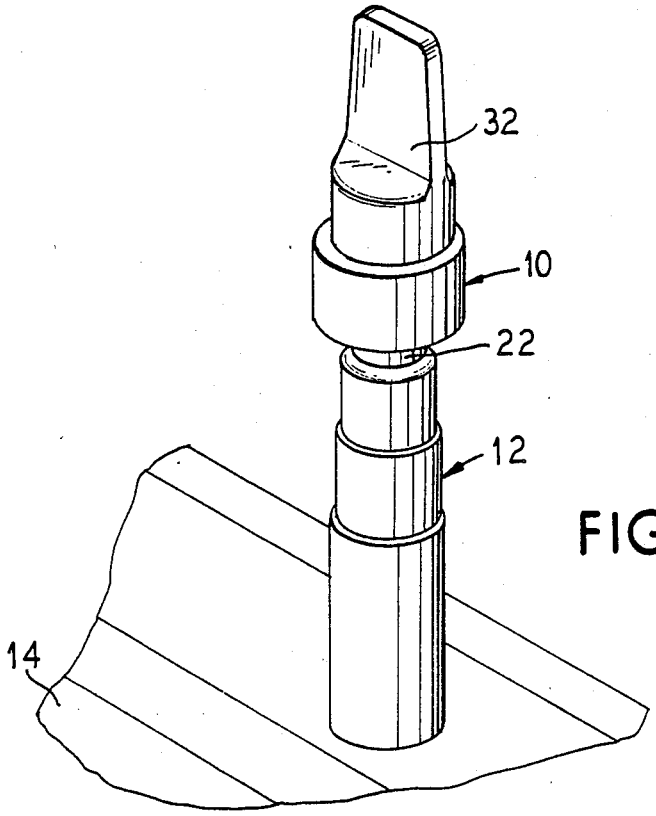
FIG. 1
FIG. 2
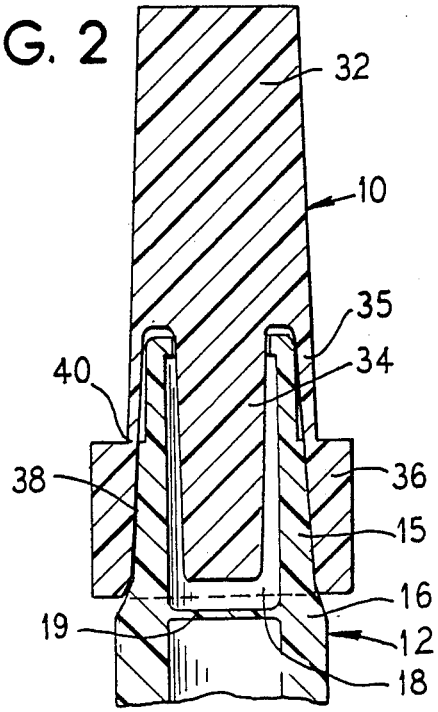
FIG. 3
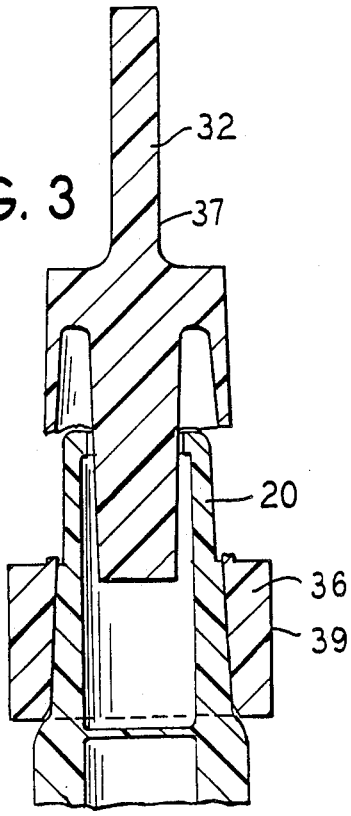

CLOSURE AND PORT ASSEMBLY

BACKGROUND OF THE INVENTION

The present invention relates generally to a pprt and closure assembly.

Ports are utilized to provide a method for accessing material packaged within a container. As used herein, the term "ports" includes, without limitation, fitments, valves, and other means for accessing a container. In the medical industry, parenteral and peritoneal dialysis solutions, for example, are packaged in flexible containers that are accessed via a port. An example of such a flexible container is the VIAFLEX collapsible plastic container sold by Baxter Healthcare Corporation of Deerfield, Ill.

In the medical industry particularly, and other applications, it is essential that the solution in the container is maintained and extracted under sterile conditions. This requires not only that the container and its contents remain in a sterile sealed condition at the time of receipt by the user, but also that no contamination of the contents occur when the container is opened by the user.

Typically, the port comprises a tubular structure with an inner bore that extends from a base. Located within the inner bore is a pierceable wall that provides a barrier between the fluid contained within the container and the outside environment. Usually, pointed means that pierce the pierceable wall are used to gain access to the fluid and thereby the container. To protect against contamination at the port exit, closures are utilized to cover the tubular bore of the port.

Some of the prior art closures have not been entirely satisfactory. Some of the problems experienced by the prior closures are the fact that they do not provide a hermetic seal, are difficult to remove, and do not lend themselves to high speed production. Furthermore, there is also the problem that the closure must be adequately secured to the port so that it does not fall off during transportation or prior to the time one desires to access the container.

Furthermore, some of the closures of the prior art have not been entirely satisfactory because they do not provide a tamper evident closure. Because it is critical that a sterile environment is maintained, it is advantageous that the closure and port cooperate to provide some means for alerting the user that the closure has been opened and accordingly, the aseptic environment violated.

A further problem with some prior art closures, is the fact that they typically cannot be used to identify the solution contained within the container once the closure is opened. To identify the type of solution contained in a container, closures may be color coded. But, once the closure is removed from the port, the container is no longer coded.

Thus, there is a need for a port and closure assembly that overcomes some of the disadvantages of the prior art.

SUMMARY OF THE INVENTION

The present invention provides an improved port and closure assembly. To this end, a port and closure assembly is provided comprising a port including a tubular portion that extends from a base, the tubular portion terminating at an end including an opening. A closure, for sealing at least a portion of the end of the port, is provided for sealing the opening of the port. The port and closure are constructed from materials that create a tack seal when the closure is positioned on the port and the port and closure are sterilized. The tack seal functions to secure the closure to the port.

In an embodiment of the present invention the closure is constructed from EPDM rubber.

In an embodiment of the present invention, the port is constructed from a polypropylene. In a preferred embodiment of the present invention, the port is constructed from a rubber modified polypropylene, such as a Kraton modified polypropylene.

In an embodiment of the present invention, the port and closure are steam sterilized.

In an embodiment of the present invention, the port and closure are presterilized by gamma sterilization.

In an embodiment of the present invention, a tamper evident closure for removably sealing an opening of a port is provided. The closure includes a first end for gripping the closure. A second end is provided that defines a sleeve portion for circumscribing a portion of the port when the closure is positioned so that it seals an opening of the port. An intermediate segment extending between the first end and the second end is provided. The intermediate segment has a portion that has a reduced cross-sectional thickness with respect to other portions of the intermediate portion. The portion has a sufficiently reduced cross-sectional thickness allowing a portion of the closure located on a first end of the portion having a reduced thickness to separate from remaining portions of the closure located on a second end of the portion having a reduced thickness when the sleeve is secured to the port. A pulling force is typically exerted on the first end to separate the portions. Preferably, the closure and port are constructed from materials that provide a tack seal when the port and closure are sterilized.

In an embodiment of the present invention, the portion having the reduced thickness is located at a point in juxtaposition to a top edge of the sleeve.

An advantage of the present invention is that it provides an improved port and closure assembly.

A further advantage of the present invention is that it provides a tamper evident closure for a port.

Still an advantage of the present invention is that it provides a port and closure assembly wherein the port and closure cooperate to create a tack seal when they are sterilized to insure that the closure is secured to the port.

Moreover, a further advantage of the present invention is that it provides a closure that can be easily removed from an opening of the port allowing the port to be accessed.

A still further advantage of the present invention is that it provides a closure that will leave a band on the port after the closure is removed.

Additional features and advantages of the present invention are described in, and will be apparent from, the detailed description of the presently preferred embodiments and from the drawings.

BRIEF DESCRIPTION OF THE DRAWINGS

FIG. 1 illustrates an exploded view of an embodiment of the port and closure assembly of the present invention.

FIG. 2 illustrates a cross-sectional perspective view of the closure and a portion of the port when the closure is secured to the port.

FIG. 3 illustrates the port and closure assembly wherein a first portion of the closure has been separated from a second portion of the closure.

DETAILED DESCRIPTION OF THE PRESENTLY PREFERRED EMBODIMENTS

Figure 4:
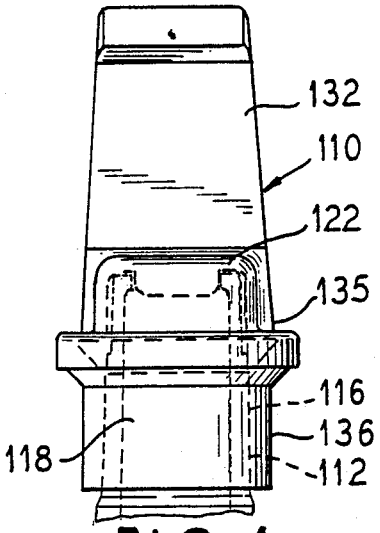
FIG. 4 illustrates a perspective view of another embodiment of the port and closure assembly of the present invention.

The present invention provides an improved port and closure assembly. Referring to FIG. 1, an embodiment of the closure 10 and port 12 is illustrated. The closure 10 is designed to seal the port 12 and provide means for accessing a container 14. The container 14 can be any container known in the art. However, the invention is directed to use with a flexible container made out of plastic or like material. The invention is particularly directed, although not exclusively, to use in medical applications wherein the container contains a fluid that must be maintained and extracted under sterile conditions. Accordingly, it is critical that sterility be maintained at the port 12.

The port 12 includes an outer wall 16 that defines a tubular bore 18. A partition wall 19 divides the tubular bore into an upper bore and a lower bore. The port 12 is typically inverted when the container is hung to dispense fluid, and the partition wall 19 functions to prevent the fluid from long term contact with the closure. Furthermore, the partition wall 19 prevents fluid flow until the container 14 is accessed by a spike. Preferably, the opening 22 has a construction that allows it to sealingly receive the spike when the spike accesses the container 14 and pierces the partition wall 19.

The upper bore, when the closure 10 does not seal the port 12, is in fluid communication with the outside environment through an opening 22. The opening 22 allows the upper bore to receive a spike or other access means that can pierce the partition wall and thereby access the port 12 and container 14.

The closure 10 functions to seal the port 12, and specifically the inside and outside of opening 22. It is especially important in medical applications that this is a hermetic seal so that when the fluid within the container is accessed for intravenous use, the fluid is not contaminated with bacteria or other contaminants.

Referring now to FIG. 2, the closure 10 is specifically illustrated. The closure 10 includes a gripping member 32 that provides a surface that can be grasped by the user when placing the closure 10 on the port 12 during assembly or removing same therefrom by the user. Extending from a portion of the gripping member 32, in the preferred embodiment illustrated, is a stem member 34. The stem member 34 has a sufficiently reduced circumference to allow it to be received within the tubular bore 18 of the port 12.

Extending from the end of the gripping member 32 is an intermediate segment 35. As discussed in more detail below, the intermediate segment 35 cooperates to define means for allowing a first portion 37, defined in part by the gripping member 32, to be separated from a second portion 39, defined by remaining portions of the closure 12.

Connected to a second end of the intermediate section 35 is a sleeve member 36. The sleeve member 36 is so constructed and arranged that it circumscribes a portion 15 of the port 12, as illustrated in FIG. 2, when the closure 10 is secured to the port 12. The sleeve member 36 defines, with the stem member 34, an interface 38 that is so constructed and arranged that it will receive the top portion 15 of the port 12 therein.

As illustrated in FIG. 2, the intermediate segment 35 includes a portion 40 having a reduced cross-sectional thickness. This portion 40 having a reduced crosssectional thickness is designed to rupture, or separate, allowing a first portion 37, defined by the gripping member 32 and a portion of the intermediate segment 35, to separate from the remaining portions 39 of the closure 10, principally, the sleeve member 36. This allows, when the sleeve member 36 is secured to the port 12, a first portion 37 of the closure 10 to be removed from the port 12, and remaining portions 39 of the closure 10, allowing the opening 22 of the port 12 to be accessed.

The closure 10, and specifically the sleeve member 36, and port 12 are so constructed and arranged that they provide a tack seal between the closure 10 and the port 12, at the interface 38, when the closure is seoured on the port. Specifically, the port 12 and closure 10 are constructed from materials that create a tack seal that is created when the port 12 and closure 10 are sterilized. This tack seal is strengthened by either steam sterilization or gamma sterilization.

Because the container 14, and port 12 and closure 10, must be sterilized before they are used, the present invention provides a port and closure assembly that reduces the manufacturing steps and costs during the manufacturing of the port and closure assembly. To this end, the closure 10 is merely stretched over the port 12 and during the sterilization process of the port 12 and closure 10 and container 14, the closure is sealed to the port.

Preferably, the port 12 is constructed from a polypropylene blend. Preferably, the port 12 is constructed from a thermoplastic elastomer modified polypropylene. In a preferred embodiment, the port 12 is constructed from a Kraton modified polypropylene.

Preferably, the closure 10 is constructed from EPDM rubber. An EPDM rubber purchased from West Company as No. 1711 Blue has been found to function satisfactorily.

In use, when it is desired to access the container 14, the user grasps the closure 10 by the gripping member 32. The user then exerts a pulling force on the gripping member 32. This causes the intermediate segment 35, and specifically the portion 40 of the segment having a reduced cross-sectional thickness to rupture. The closure 10 is then separated into a first 37 and second portion 39 exposing the opening 22 of the port 14.

A tamper evident closure is provided in that after the closure 10 has been separated into a first portion 37 and second portion 39, the sleeve 36 still circumscribes the port 12. If desired, the sleeve 36 can be color coded to identify the contents of the container.

Figure 5:
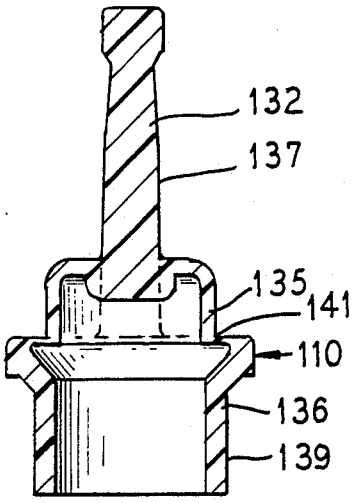
FIG. 5 illustrates a cross-sectional view of the closure assembly of FIG. 4.

Referring now to FIGS. 4 and 5, another embodiment of the port 112 and closure 110 assembly of the present invention is illustrated. Again, the port 112 includes an outer wall 116 that defines a tubular bore 118. The closure 110 functions to seal the port 112 and specifically, an opening 122 defined by the port 112.

The closure 110 includes a gripping member 132 that provides a surface that can be grasped by the user when placed in the closure 110 and the port 112 during assembly or removing same therefrom by the user.

Extending from an end of the gripping member 132 is an intermediate segment 135. The intermediate segment 135 cooperates to define means for allowing a first portion 137, defined, in part, by the gripping member 132 to be separated from a second portion 139 defined by remaining portions of the closure 110.

In this regard, again, connected to a second end of the intermediate segment 135 is a sleeve member 136. The sleeve member 136 is so constructed and arranged that it circumscribes a portion of the port 112 as illustrated in FIG. 4. As in the previous embodiment, a first portion of the closure is designed to separate from a second portion a closure when a sufficient pulling force is exerted on the gripping member. The closure 110 is designed to separate at point 141. The closure 110 is constructed from a material that creates a tack seal with the port 112, as in the previous embodiment.

Figure 6:
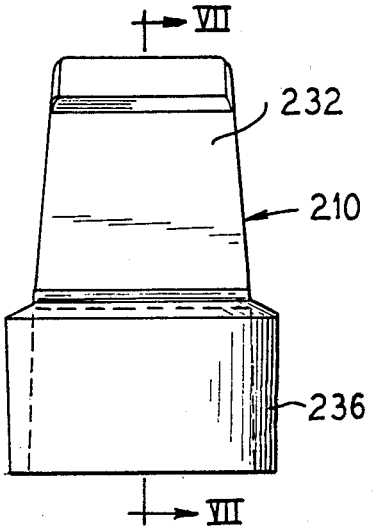
FIG. 6 illustrates a perspective view of another embodiment of the closure assembly of the present invention.
Figure 7:
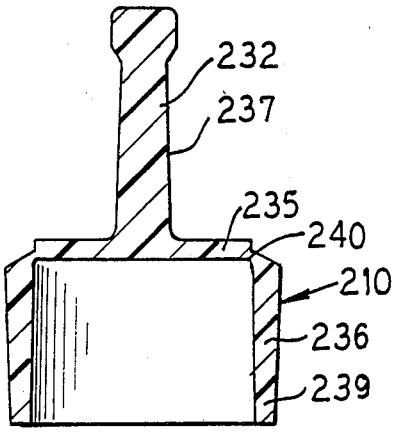
FIG. 7 illustrates a cross-sectional view of the closure assembly of FIG. 6 taken along lines VII—VII of FIG. 6.

Referring now to FIGS. 6 and 7, another embodiment of the closure assembly of the present invention is illustrated. The closure assembly 210 can be used with a port such as those illustrated in FIGS. 1–4. Again, the closure 210 is constructed from a material that creates a tack seal with the port as in the previous embodiments.

In this embodiment, the closure 210 includes a gripping member 232, a sleeve member 236 and an intermediate section 235. Located between intermediate section 235 and sleeve member 236 is a point 240 of reduced thickness along which the closure 210 will rupture when a sufficient pulling force is exerted against the gripping member 232.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A port and closure assembly comprising:

a port including a tubular portion that extends from a base, the tubular portion terminating at an end including an opening; and a closure, for sealing at least a portion of the end of the port, the port and closure being constructed from materials that create a tack seal when the closure is positioned on the port and the port and closure are sterilized, the tack seal functioning to secure the closure to the port.

2. The port and closure assembly of claim 1 wherein the closure is constructed from EPDM rubber.

3. The port and closure assembly of claim 1 wherein the port is constructed from a polypropylene.

4. The port and closure of claim 1 wherein the port is constructed from a thermoplastic elastomer modified polypropylene.

5. The port and closure assembly of claim 1 wherein the port is constructed from a Kraton modified polypropylene.

6. The port and closure assembly of claim 1 wherein the port and closure are steam sterilized.

7. The port and closure assembly of claim 1 wherein the port and closure are sterilized by gamma sterilization.

8. The port and closure assembly of claim 1 wherein the port is constructed from polypropylene blend and the closure is constructed from EPDM rubber.

9. A tamper evident closure for removably sealing an opening of a port comprising:

a first end for gripping the closure;

a second end, defining a sleeve portion, for circumscribing a portion of the port when the closure is positioned so that it seals the opening of the port;

an intermediate segment extending between the first end and the second end, the intermediate segment having a portion that has a reduced cross-sectional thickness with respect to other portions of the intermediate portion, the portion having a sufficiently reduced cross-sectional thickness allowing a portion of the closure located on a first side of the portion having a reduced thickness to separate from a portion of the closure located on a second side of the portion having a reduced thickness, when the sleeve is secured to the port and a sufficient pulling force is exerted on the first end; and the closure cooperating with the port to provide a tack seal upon sterilization of the closure and port.

10. The tamper evident closure of claim 9 wherein the portion having a reduced thickness is located at a point in juxtaposition to a top end of the sleeve.

11. The tamper evident closure of claim 9 wherein the first end includes a member that extends into a channel area that is defined by the sleeve.

12. The tamper evident closure of claim 9 wherein the closure is constructed from EPDM rubber.

13. The tamper evident closure of claim 12 wherein the port is constructed from a Kraton modified polypropylene.

14. The tamper evident closure of claim 9 wherein the port is constructed from a thermoplastio elastomer modified polypropylene.

15. The tamper evident closure of claim 9 wherein the closure is so constructed and arranged that the sleeve circumscribes a portion of the port and an opening of the port can be accessed when the closure separates along the portion of reduced thickness.

16. A port and closure assembly comprising:

a port including a tubular portion that extends from a base and terminates at an end having an opening;

a closure, for sealing at least a portion of the end portion of the port, the closure including at one end a gripping member, at a second end a sleeve member that circumscribes a portion of the end of the port when the closure is positioned over the port, and an intermediate portion located between the first and second ends, the intermediate portion including means for allowing a first portion of the port, that is defined at least in part by the first end, to separate from a second portion of the port, that is defined at least in part by the second end; and the closure and port cooperate to provide a tack seal upon sterilization of the closure and port.

17. The port and closure assembly of claim 16 wherein:

the port is constructed from a rubber modified polypropylene; and the closure is constructed from EPDM rubber.

18. The port and closure assembly of claim 16 wherein the port and closure are steam sterilized.

19. The port and closure assembly of claim 16 wherein the port and closure are gamma sterilized.

20. The port and closure assembly of claim 16 wherein the sleeve of the closure circumscribes a portion of the port after the first portion of the closure separates from a second portion of the closure.

21. The port and closure assembly of claim 20 wherein the sleeve is color coded.

* * * * *

UNITED STATES PATENT AND TRADEMARK OFFICE

CERTIFICATE OF CORRECTION

PATENT NO. : 4,903,855

DATED : February 27, 1990

INVENTOR(S) : James Ducay, Josef Schmidt, Hugh Forman

It is certified that error appears in the above-identified patent and that said Letters Patent is hereby corrected as shown below:

In column 6, at line 39, delete "thermoplastio" and substitute --thermoplastic-- therefor.

Signed and Sealed this

Twenty-sixth Day of March, 1991

*Attest:*

HARRY F. MANBECK, JR.

*Attesting Officer*

*Commissioner of Patents and Trademarks*